United States Patent [19]

Steiger

[11] Patent Number: 4,569,440

[45] Date of Patent: Feb. 11, 1986

[54] CARRIER FOR BOTTLES AND THE LIKE

[75] Inventor: Thomas W. Steiger, Pompano Beach, Fla.

[73] Assignee: Cosden Technology, Inc., Dallas, Tex.

[21] Appl. No.: 755,551

[22] Filed: Jul. 16, 1985

Related U.S. Application Data

[63] Continuation-in-part of Ser. No. 633,773, Jul. 28, 1984, abandoned.

[51] Int. Cl.[4] ..... B65D 75/00

[52] U.S. Cl. ..... 206/159; 206/160; 206/161

[58] Field of Search ..... 206/427, 159, 160, 161, 206/158

[56] References Cited

U.S. PATENT DOCUMENTS

| | | | |
|---|---|---|---|
| 3,203,581 | 8/1965 | Wherry | 206/159 |
| 3,203,582 | 8/1965 | Waggner, III | 206/159 |
| 3,369,696 | 2/1968 | Erickson | 206/159 |
| 3,664,496 | 5/1972 | Mascia | 206/159 |
| 3,760,974 | 9/1973 | Oglesbee | 206/427 |
| 3,951,259 | 4/1976 | Oglesbee | 206/427 |
| 4,288,013 | 9/1981 | Napier | 206/159 |

*Primary Examiner*—Joseph Man-Fu Moy
*Attorney, Agent, or Firm*—Roy L. Van Winkle; M. Norwood Cheairs

[57] ABSTRACT

The bottle carrier includes an upper support having a plurality of resilient neck engaging fingers that are aligned with a like number of bottom engaging members carried by a lower support. The upper and lower supports are held in spaced relationship by a pair of spacer members so that bottles placed in the carrier are engaged by the bottom engaging members in the concave bottom of the bottle and engaged at the neck by resilient fingers. The carrier is preferably constructed from a high impact styrene.

5 Claims, 3 Drawing Figures

CARRIER FOR BOTTLES AND THE LIKE

This application is a continuation in part of application Ser. No. 633,773, filed July 28, 1984 and now abandoned.

BACKGROUND OF THE INVENTION

This invention relates generally to improved bottle carriers whereby a person can conveniently carry a plurality of bottles. More particularly, but not by way of limitation, this invention relates to a light weight bottle carrier, preferably constructed from plastic, that facilitates the carrying of a six-pack of bottles and the like.

Initially, bottles, such as soft drink bottles, were simply placed in wooden boxes and transported in this manner. Later, dividers were added in the boxes to prevent the bottles from banging together and breaking since, at the time, the bottles were generally constructed from glass. In more recent years, the sale of soft drinks and the like in six pack units has become popular and a variety of designs have been utilized for facilitating the carrying of the six bottles by one person. Initially, the early six pack designs were simply constructed from cardboard or heavy paper and emulated the divided cases, except that they only held six bottles and were generally provided with some form of carrying handle.

More recently, plastics have been utilized more and more as they have become less expensive and stronger, to construct the six pack carriers. Initially, the plastic carriers were constructed very much as where the paper carriers.

With the advent of plastic bottles, and especially in the larger sizes, bottles have been shaped in a manner that somewhat lends itself to more unique carrier designs. For example, many of the bottles are provided with concave bottoms so that the relatively thin plastic containers are capable of holding the pressure applied inside the bottles. As is well known, the bottles are also necked down to provide for convenience of pouring and for reducing the size of the cap, thereby making it easier to contain the pressure within the bottle.

Bottle carriers constructed in the past have worked reasonably well. However, the paper containers were subject to disintegration if they became wet, the initial plastic containers were relatively expensive, and many of the later designed containers were not reusable.

An object of this invention is to provide an improved bottle carrier that is reusable, extremely light weight, designed for the more modern plastic bottles, and one that is relatively expensive.

SUMMARY OF THE INVENTION

This invention then provides an improved carrier for bottles wherein the bottles include concave bottoms and reduced neck portions. Each of the neck portions has a radially projecting flange thereon. The carrier comprises a lower support that includes an elongated portion and a plurality of spaced, bottom engaging members on the elongated portion that project into and engage the concave bottoms of the bottles. An upper support includes a neck engaging member for each bottom engaging member and a connecting portion that holds the neck engaging members in alignment with the bottom engaging members. Each of the neck engaging members includes a pair of opposed, arcuate resilient fingers that substantially encircle the reduced diameter neck portion adjacent to and relatively below the flange for retaining the bottle in the carrier. The carrier also includes a spacer that extends between and connects the upper and lower supports for holding the upper and lower supports in the desired spaced relationship.

BRIEF DESCRIPTION OF THE DRAWING

The foregoing objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
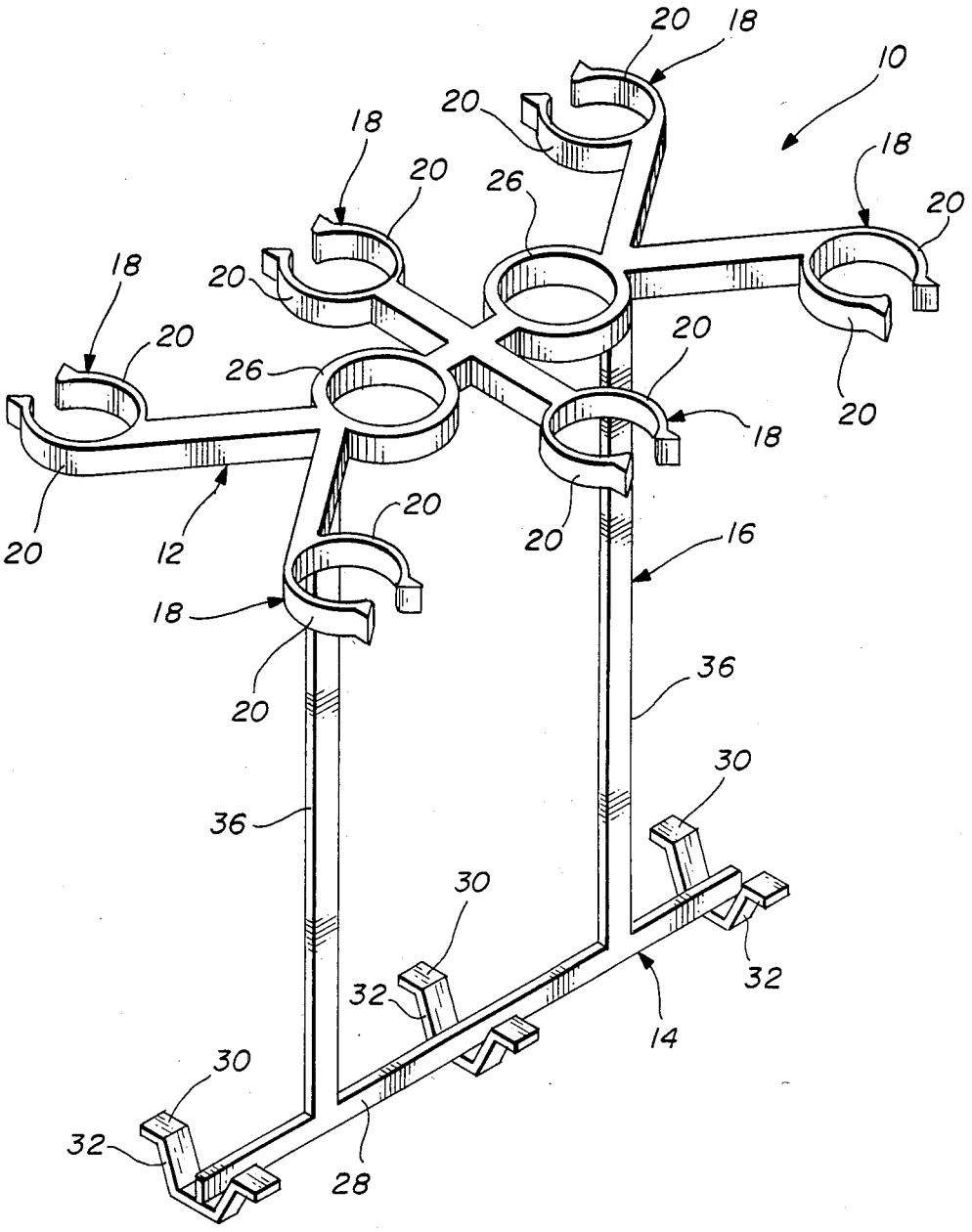
FIG. 1 is a pictorial view of a carrier that is constructed in accordance with the invention.

Referring to the drawing, and to FIG. 1 in particular, shown therein and generally designated by the reference character 10, is a bottle carrier that is constructed in accordance with the invention. The bottle carrier 10 includes an upper support 12, a lower support 14, and a spacer 16 that extends between, connects and retains the upper support 12 and the lower support 14 in spaced relationship.

Figure 2:
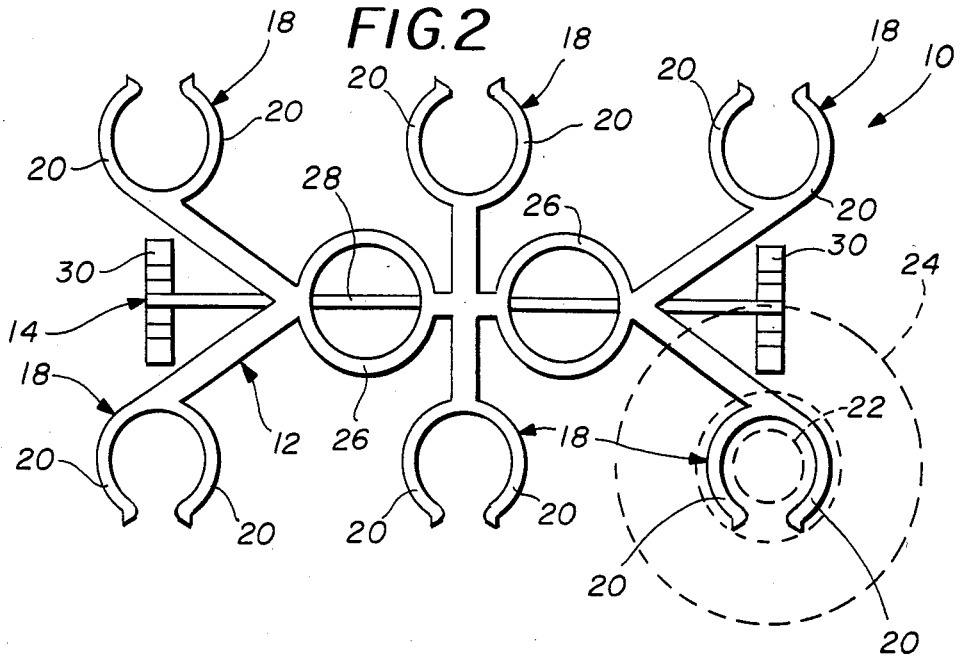
FIG. 2 is a top plan view of the bottle carrier of FIG. 1.
Figure 3:
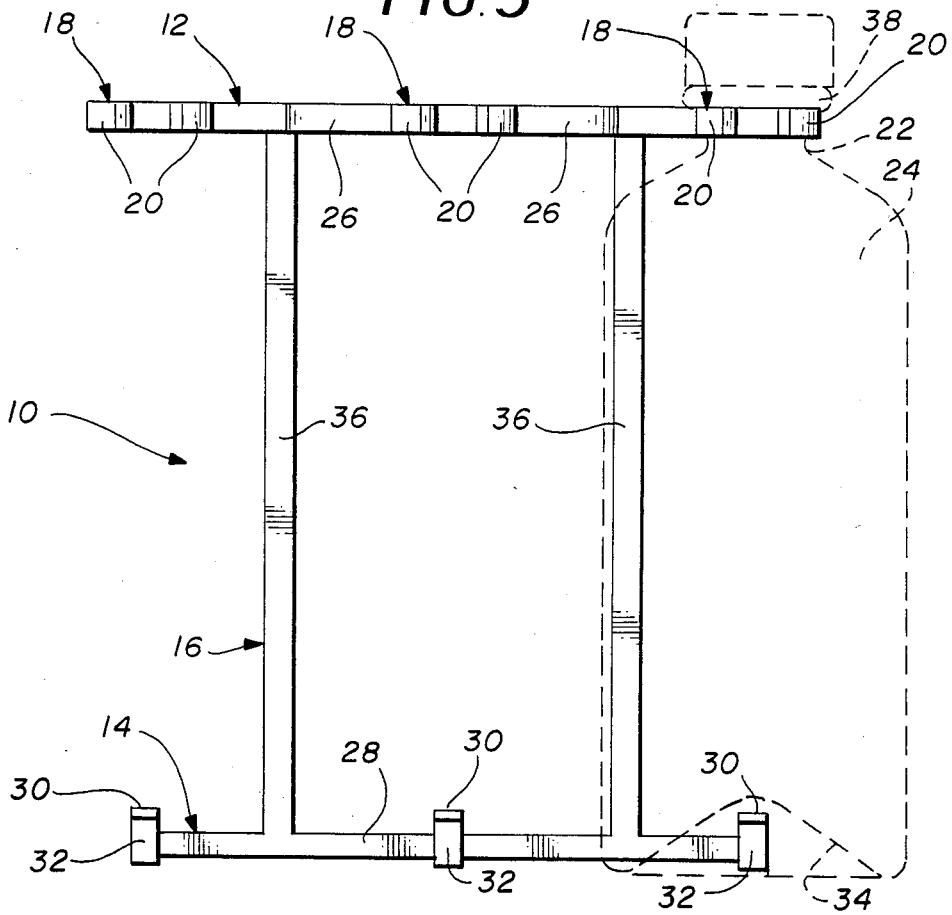
FIG. 3 is a side elevation view of the bottle carrier of FIG. 1.

The upper support 12 includes a plurality of neck engaging members 18, each of which includes a pair of arcuate, resilient fingers 20 that are arranged to engage the neck 22 of a bottle 24 (see FIGS. 2 and 3).

The upper support 12 also includes a pair of rings 26 through which a person carrying the bottle carrier 10 can insert his thumb and finger to facilitate the carrying of the carrier 10 and the bottles 24 that may be located therein. The rings 26 and the neck engaging members 18 are, of course, interconnected by appropriate members so that they form a unitary upper support 12.

The lower support 14 includes an elongated portion 28 that has a plurality of bottom engaging portions 30 located thereon. Each of the bottom engaging portions 30 includes an upwardly and outwardly extending portion 32 that is arranged to project into a concavity 34 in the bottom of the bottles 24 (see FIG. 3). In FIGS. 1 and 2, the portions 30 are relatively short and are arranged so that the upwardly and outwardly projecting strap-like portions 32 engage bottles 24 in the concavities 34 to securely hold the bottoms of the bottles 24 in the carrier 10. Due to the resiliency of the plastic, the portions 30 exert a force on the bottoms of the bottles 24 resiliently biasing the bottoms toward the elongated portion 28.

The spacer 16 includes a pair of spaced, usually vertically disposed, members 36 that extend between and are connected to the lower support 14 and the upper support 12. The members 36 are designed to be of such a length that the fingers 20 on the upper support 12 will be disposed around the bottle neck 22 and below a flange 38 thereon when the bottle engaging portions 30 are in engagement with the concavity 34 in the bottom of the bottle 24.

The carrier 10 is constructed from a resilient material so that the fingers 20 can be deformed to encircle the neck 22 of the bottles 24. However, the material should have sufficient strength so that when the carrier 10 is filled with bottles 24 that are full of liquids, the fingers 20 and the bottle engaging portions 30 have sufficient rigidity so that the bottles 24 cannot drop out of the carrier 10.

Such resiliency with the desired rigidity is provided by a plastic from which the carrier 10 is molded. The preferred plastic is a high impact styrene, which provides the desired strength and resiliency characteristics and provides a carrier 10 that is reusable. The carrier is not destroyed by removal of the bottles 24 therefrom.

In use, bottles 24 are placed in the carrier 10 by inserting the concavity 34 in the bottle 24 over one of the bottom engaging members 30, swinging the bottle 24 toward the carrier 10 so that the neck 22 engages the resilient fingers 20. A slight amount of force on the bottle 24 spreads the fingers 20 sufficiently to place the neck 22 within the member 18. Thus, the bottles 24 are securely retained in the carrier 10 by the fingers 20 on the upper support 12 which substantially encircle the necks 22 and by the resilient biasing force exerted by the portions 30 located on the lower support 14 which are in engagement with the bottoms of the bottles 24.

It should be apparent from the foregoing, that the bottle carrier 10 is easily, quickly, and inexpensively constructed by molding and gluing or welding as desired, that it is extremely light weight due to the configuration described, and that the use of the preferred materials provides a dependable and reusable carrier.

It will be understood that the carrier described in detail hereinbefore is presented by way of example only, and that many changes and modifications can be made thereto without departing from the spirit or scope of the annexed claims.

What is claimed is:

1. An improved carrier for bottles that includes concave bottoms and reduced diameter neck portions, each neck portion having a radially projecting flange thereon, said carrier comprising:

lower support means including an elongated portion and a plurality of spaced, bottom engaging means on said elongated portion, each said bottom engaging means including an upwardly and outwardly extending resilient cantilever portion of generally strap-like configuration projecting into one of said concave bottoms and engaging said bottom for resiliently urging each said bottom towards said elongated portion;

upper support means including a neck engaging member for each bottom engaging member and a connecting portion holding said neck engaging members in alignment with said bottom engaging members, each said neck engaging member including a pair of opposed, or arcuate resilient fingers substantially encircling said reduced diameter neck portion adjacent to and relatively below said flange for retaining said bottles in said carriers; and, spacer means extending between and connected to said upper and lower support means for holding said upper and lower support means in spaced relationship.

2. The carrier of claim 1 wherein said connecting portion has a pair of spaced ring portions for facilitating carrying said carrier and bottles.

3. The carrier of claim 2 wherein said carrier is formed from plastic.

4. The carrier of claim 3 wherein said plastic is high-impact styrene.

5. The carrier of claim 1 wherein said spacer means includes a pair of spaced elongated members, each having an upper end connected to said connecting portion and a lower end connected to the elongated portion of said lower support means.

* * * * *